US008056724B2

(12) United States Patent
Estep

(10) Patent No.: US 8,056,724 B2
(45) Date of Patent: Nov. 15, 2011

(54) PHARMACY BOTTLES

(76) Inventor: Brian J. Estep, San Antonio, TX (US)

( * ) Notice: Subject to any disclaimer, the term of this patent is extended or adjusted under 35 U.S.C. 154(b) by 293 days.

(21) Appl. No.: 12/191,416

(22) Filed: Aug. 14, 2008

(65) Prior Publication Data

US 2010/0038279 A1 Feb. 18, 2010

(51) Int. Cl.
*B65D 83/04* (2006.01)

(52) U.S. Cl. ..... 206/534; 206/459.5; 215/230

(58) Field of Classification Search ..... 206/534, 206/528, 529, 540, 459.1, 459.5, 533, 828; 40/310, 311; 220/259.3, 288; 215/230, 329, 215/316, 365, 216–222, 201, 206, 295, 302
See application file for complete search history.

(56) References Cited

U.S. PATENT DOCUMENTS

| | | | | |
|---|---|---|---|---|
| 4,462,501 | A * | 7/1984 | Franchi | 215/296 |
| 4,749,093 | A * | 6/1988 | Trick | 215/220 |
| 4,782,966 | A * | 11/1988 | Thackrey | 215/230 |
| 5,938,055 | A * | 8/1999 | Philips et al. | 215/222 |
| 6,360,462 | B1 * | 3/2002 | Mengel | 40/310 |
| 6,612,451 | B2 * | 9/2003 | Tobias et al. | 215/375 |
| D540,179 | S | 4/2007 | Adler | |
| D540,690 | S | 4/2007 | Adler | |
| D542,661 | S | 5/2007 | Adler | |
| 7,311,205 | B2 | 12/2007 | Adler | |
| 7,413,082 | B2 | 8/2008 | Adler | |
| 7,857,134 | B2 * | 12/2010 | Koch | 206/534 |
| 2003/0196924 | A1 * | 10/2003 | Zilberman | 206/459.5 |
| 2003/0214129 | A1 | 11/2003 | Adler | |
| 2004/0045856 | A1 * | 3/2004 | Rhoades | 206/459.5 |
| 2004/0045863 | A1 * | 3/2004 | Rhoades | 206/534 |
| 2006/0163869 | A1 * | 7/2006 | Adler et al. | 283/81 |
| 2007/0029788 | A1 | 2/2007 | Adler | |
| 2008/0017602 | A1 | 1/2008 | Adler | |
| 2008/0121545 | A1 * | 5/2008 | Jones | 206/459.5 |
| 2009/0236258 | A1 * | 9/2009 | Connell | 206/540 |
| 2010/0133139 | A1 * | 6/2010 | Lowe | 206/534 |

* cited by examiner

*Primary Examiner* — J. Gregory Pickett
*Assistant Examiner* — Robert Poon
(74) *Attorney, Agent, or Firm* — Gunn, Lee & Cave, P.C.

(57) ABSTRACT

A pharmacy bottle for prescription medication is shown that conveys information thereon to the patient that is clear and understandable. Colored rings are attachable to the cap of the pharmacy bottle to convey general information. Increased surface area of the pharmacy bottle is provided for more specific information to be conveyed to the patient via the label adhered thereto. Further, more detailed information about the prescription is conveyed to the patient by ancillary information sheet(s) inserted through slot(s) into space formed in walls of the pharmacy bottle. One end of the ancillary information sheet(s) forms a tab extending from the slot(s) that may be pulled by the patient to remove the ancillary information sheet from the space via the slot(s) for review by the patient.

6 Claims, 8 Drawing Sheets

42 38 26

JOHN DOE

GENERIC NAME: - AZATHIOPRINE (aze-uh-THIGH-oh-preen)

BRAND NAME(S): Imuran

WARNING: Long-term use of this medication increases the risk of developing neoplasias (cancerous or noncancerous growths). Azathioprine can also cause blood disorders (e.g., leukopenia). Immediately notify your doctor if you develop unusual growths, easy bruising or bleeding, or signs of infection such as persistent or fever.

USES: Azathioprine is used to prevent rejection of transplanted organs and for cases of severe that do not respond to other therapies.

OTHER USES: This medication may also be used to treat and for other purposes as determined by your doctor.

HOW TO USE: Azathioprine tablets should be taken with food or milk to prevent stomach upset. Take this medication exactly as prescribed. Do not stop taking the medication without your doctor's approval.

SIDE EFFECTS: Nausea/vomiting, loss of appetite or may occur. If these effects persist or worsen, notify your doctor promptly. Unlikely but report promptly: , unusual fatigue, stomach pain, joint or , vision changes. Very unlikely but report promptly: yellowing of eyes or skin, darkened urine, unusual bleeding or bruising, unusual lumps or growths. In the unlikely event you have an allergic reaction to this drug, seek medical attention immediately. Symptoms of an allergic reaction include: itching, swelling, dizziness, trouble breathing. If you notice other effects not listed above, contact your doctor or pharmacist.

42

Fig. 15a

26

AZATHIOPRINE

AZATHIOPRINE_ORAL (cont.)

PRECAUTIONS: Before you take azathioprine, tell your doctor your medical history especially if you have: liver disease, blood disorders, any infection, any allergies. This medication can increase your risk of developing an infection. Notify your doctor at the first sign of a possible infection (fever, persistent sore throat). Azathioprine is not recommended for use during. Consult your doctor before using it. This drug is excreted into milk. Breast-feeding while using this medication is not recommended. Consult your doctor before breast-feeding.

DRUG INTERACTIONS: Tell your doctor of all drugs you may use, (both prescription and nonprescription), especially of: blood thinners (e.g., , heparins), , drugs affecting bone marrow (e.g., cotrimoxazole, numerous anti-cancer drugs), "alkylating" type drugs (e.g., chlorambucil, melphalan, cyclosporine), (e.g., ). Do not start or stop any medicine without doctor or pharmacist approval.

OVERDOSE: If overdose is suspected, contact your local poison control center or emergency room immediately. US residents can call the US national poison hotline at 1-800-222-1222. Canadian residents should call their local poison control center directly. Symptoms of overdose may include nausea, vomiting, and diarrhea.

NOTES: Lab tests will be done frequently while taking this medication to monitor its effects. Do not allow anyone else to take this medication.

MISSED DOSE: If you take this once daily and miss a dose, take it as soon as remembered but not if it is almost time for the next dose. Skip the missed dose and resume regular schedule. Do not double-up the dose to catch up. If you take this several times daily and miss one dose, take it as soon as you can or double-up the very next dose. If you miss more than one dose, contact your doctor. You may need to have your dosing schedule adjusted.

STORAGE: Store at room temperature away from moisture and sunlight. Do not store in the bathroom.

Fig. 15b

PHARMACY BOTTLES

FIELD OF THE INVENTION

This invention relates to pharmacy bottles and, more particularly, a pharmacy bottle that conveys the maximum amount of information to a patient receiving prescription medication.

BACKGROUND OF THE INVENTION

For a patient that buys prescription medication, the amount of information and warnings conveyed to the patient is overwhelming. Typically, there is a label stuck to the bottle with various information and warnings thereon. For example, the prescribing physician will be named, the patient will be named, the type and dosage of medication will be given, as well as, how often the patient should take the medication each day. There probably will be a reminder concerning refills and warnings about the medication.

Because there is not enough room on the label that is stuck on the bottle to give all of the warnings and side effect of the medication, the bottle containing the medication is typically put in a bag and stapled to the top of the bag is additional product information or warnings. As a practical matter, normally the patient tears open the bag, gets out the bottle containing the medication and throws the bag with all of the product information and/or warnings stapled thereto away. It is very rare that a patient reads the product information or warnings that are stapled to the bag before it is thrown away.

If it was practical to put more product information or warnings with the container that has the medication therein, typically the patient will stand a much higher probability of reading the product information or warnings. If the product information or warnings are stapled to the bag, normally such product information or warnings are never read.

As an example of an attempt by the industry to add more information to the label, U.S. Pat. No. 7,311,205 by Adler et al shows a generally wedge shaped bottle with a curved top that allows the label to be wrapped thereover. The bottle opening is at the bottom. Due to a recess between the label and the bottle, additional product information can be inserted in that recess. However, since the bottle as shown in U.S. Pat. No. 7,311,205 has been on the market, it has received a large amount of criticism by the consuming public.

One of the largest manufacturers of containers for prescription drugs is Berry Plastics Corporation. While Berry Plastics has a complete line of prescription containers that can be selected by "family" or "size" on their website of www.berryplastics.com, the containers have the problem of insufficient room to put all of the information concerning the medication on the container so it can be seen by the patient. The most common line by Berry Plastics is the "Friendly & Safe" prescription container with the locking top. The Friendly & Safe prescription containers come in a number of different sizes. Regardless of the size, the problem of sufficient surface area to put all of the information needed on a pharmacy container still exists.

While a lack of space to put proper warnings and/or information on the prescription container is a problem, many patients take their medication by shape of the pill, shape of the bottle or other external factors other than reading the label itself. If there are multiple people in the household taking prescription medication, such as an elderly couple, some times the individuals get confused and take the other persons medication. While various systems have been devised to avoid the confusion, mistakes still occur.

The best reminder system would be one the patient can devise for themself. For example, an elderly couple, both of whom take prescription medication, might have different colors for their bottles or caps. As an example, the wife can take the color red and the husband take the color green. Therefore, all of the medication in the red capped container is for the wife and all of the medication in the green capped container is for the husband.

Another example may be different colors being used as reminders of when to take the medication. The color black could be used for medication to be taken in the evening and the color white for medication to be taken in the morning.

Whatever system is being used, there is a drastic need to convey information in an easy to understand form to the patient that is taking the prescription medication. Some information such as warnings should be given in detail. However, other information such as whose medication it is may be conveyed by colors. Whatever system is used, the object is to convey the maximum amount of information to the patient in a manner the patient will absorb and utilize.

SUMMARY OF THE INVENTION

It is an object of the present invention to provide a pharmacy bottle that conveys the maximum amount of information to the patient.

It is another object of the present invention to provide a pharmacy bottle for prescription medication where essentially all of the vertical surfaces of the pharmacy bottle may be used to convey information to the patient.

It is yet another object of the present invention to provide a pharmacy bottle for prescription medication that conveys the maximum amount of information to the patient on the vertical surfaces area thereof, but also has a slot where additional information can be inserted.

It is even another object of the present invention to provide a pharmacy bottle for prescription medication that has a slot access to a space between an internal wall and an external wall where ancillary information sheets can be inserted for the patient.

It is yet another object to provide a pharmacy bottle for prescription medications where the most critical information is communicated to the patient in the vertical surface area of the pharmacy bottle, but a slotted space in the wall contains ancillary information sheets for the patient about the prescription medication.

It is a further object of the present invention to provide colored rings that can be attached the cap of a pharmacy bottle for prescription medications, the colored rings being selectable by the patient to provide quick visual reminders to the patient when taking the prescription medication It is still another object of the present invention to provide colored rings for a pharmacy bottle of prescription medication, which colored rings are clipped into pre-existing slots in the cap for the pharmacy bottle.

A new pharmacy bottle for prescription medication has been designed to maximize the amount of information communicated to the patient receiving the prescription medication. Essentially all of the vertical surfaces for the prescription bottle are available to receive labels adhered thereto. These labels will contain information to be conveyed to the patient such as (a) name of the doctor, (b) name of the patient, (c) name of the drug, (d) dosage of the drug, (e) refills of the drug, (f) frequency with which the drug is to be taken, (g) bar code for the drug, and/or (h) warnings for the drug. These are just some of the information that should be conveyed to the patient or pharmacist about the prescription medication.

Further, general information should be conveyed to the patient concerning the drug, such as how the drug is used, side effects, drug interactions, just to give a few some examples. However, all of the additional information concerning the drug typically will not fit on the label attached to the bottle. If the size of the print for the information on label is reduced, the likelihood of the information ever being read by the patient is likewise reduced. By having an inner wall and an outer wall of the pharmacy bottle, the additional information concerning the prescription medication can be put on an ancillary information sheet and inserted through a slot into that space with a tab extending from the slot so the ancillary information sheet can be subsequently retrieved by the patient. Thereafter, if there is a missed dose, overdose, drug interaction, or drug side effects, the patient can quickly retrieve the ancillary information sheet from the slot by pulling on the tab extending therefrom. The patient can then read the additional information on the ancillary information sheet concerning the prescription medication and act accordingly.

One way of providing the additional information is a "bottle within a bottle" with a space therebetween. The external wall of the outer bottle would have a slot or slots therein into which the ancillary information sheet may be inserted, but leaving a tab portion extending outside the slot. The ancillary information sheet may be on a single printed sheet, folded printed sheets, or multiple printed sheets the size being determined by the amount of information to be conveyed. This additional information is referred to in this application as an "ancillary information sheet," which can be removed at any time and read by the patient. The information contained on the ancillary information sheet is in addition to the information contained on the label that is attached to the pharmacy bottle.

While the ancillary information sheet can be inserted on the side of the pharmacy bottle, also an ancillary information sheet can be inserted from the top into a top slot between an internal wall and an external wall of the pharmacy bottle. Single or multiple ancillary information sheets can included in one or more slots.

For the less observant patient that does not read the information contained on the label, colored rings may be attached to the bottle cap. The most common type of bottle cap is sold under the mark "Friendly & Safe" by Berry Plastics Corporation. The Friendly & Safe cap has interlocking tabs and probably constitutes the majority of the caps used in the pharmacy industry for prescription medication in solid form such as pills or tablets. By having interlocking extensions that fit in the indentations of the Friendly & Safe cap, colored rings can be attached to the cap. The colored ring or rings could be selected based upon the preferences of the patient. For example, if more than one patient lives in a household, each of which has their own prescription medication, a different colored ring can be used by each patient. When picking up the medication, the appropriately colored ring could be attached to the Friendly & Safe cap.

Assume the patient wants different colored rings to remind themselves of when the medication is to be taken. For example, a black ring could be used to indicate the medication is to be taken in he evening or at night or a white ring could be used to indicate the medication is to be taken in the morning. The tabs extending downward from the colored ring can lock into the indentations of the Friendly & Safe cap. Multiple colored rings could be used on a cap if desired. The purpose of the colored rings is to ensure the right patient is taking the right medication at the right time. This is a quick visual indication to the patient.

While only certain shaped pharmacy bottles are shown, the variety of shapes are almost endless with slots being formed between an internal wall and an external wall through which ancillary information sheets can be inserted. The pharmacy bottles can be rectangular or circular. The bottle caps or the cover for the opening in the pharmacy bottle could be of any type. The objective is to convey as much information to the patient receiving the prescription medication as possible, yet still convey the information in a form that has the highest probability of being utilized and understood by the patient.

BRIEF DESCRIPTION OF THE DRAWINGS

FIG. 15 is a typical ancillary information sheet that may be inserted in the slot of the pharmacy bottle shown in FIGS. 1A and 1B.

DETAILED DESCRIPTION OF THE PREFERRED EMBODIMENT

Figure 14:
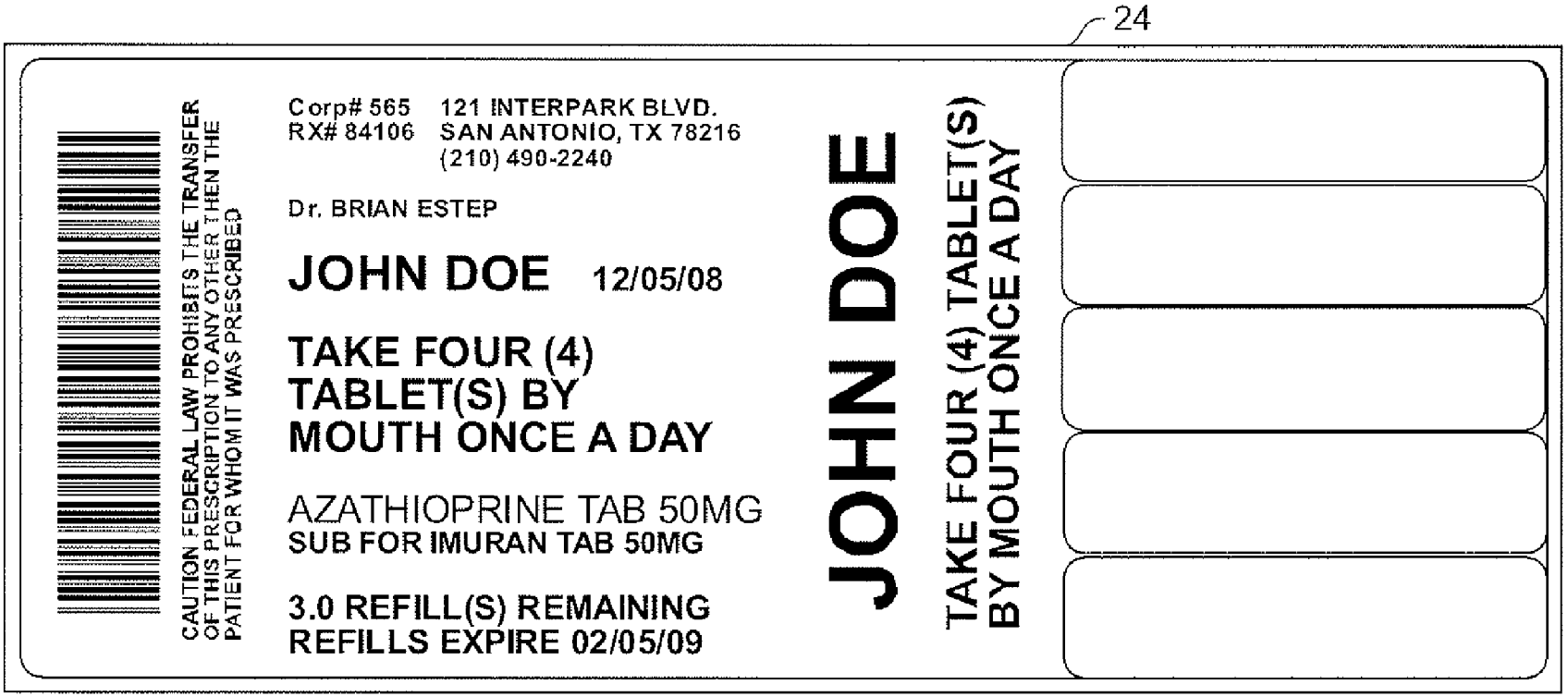
FIG. 14 is a typical label that may be applied to the external vertical surfaces of the pharmacy bottle shown in FIGS. 1A and 1B.

Referring to FIGS. 1A, 1B, 2, 3, 4, and 5 in combination, a pharmacy bottle 10 is shown with a safety cap 12 thereon. The safety cap 12 may be the "Friendly & Safe" type manufactured by Berry Plastics Corporation. The pharmacy bottle 10 is rectangular in shape with rounded external corners 14 (see FIG. 3) between the front surface 16, left side 18, back surface 20 and right side 22. A label 24 is stuck to the pharmacy bottle 10 and wrapped around the front surface 16, left side 18, back surface 20 and right side 22. A typical such label 24 is shown in FIG. 14. The rounded external corners 14 allow the label 24 to be wrapped around and stuck to the external surfaces pharmacy bottle 10 in one simple motion by the pharmacist or technician.

By use of a rectangular pharmacy bottle 10, the maximum amount of information can be conveyed on the label 24 for good comprehension by the patient receiving the prescription medication. For example, in referring to the prescription medicine being prescribed for John Doe as illustrated in FIG. 14, information that is desirable to be contained on the label 24 is illustrated. On the front surface 15 would be all of the warnings that would typically be conveyed to the patient. On the left side 18 would be given the patient's name and when to take the medication. On the back side surface 20, the doctor's name, patient's name, type of drug, dosage, refills, and expiration date would be indicated. While this is referred to as the "back surface," it is the surface the patient will have the greatest tendency to review. On the right side 22 would be the bar code information that is important to the pharmacy selling the medication. With the use of the label 24 on the pharmacy bottle 10, a maximum amount of information can be conveyed to the patient in a manner the patient could readily comprehend.

Normally when a pharmacist gives a pharmacy bottle containing prescription medication to the person picking up the prescription, additional information concerning the prescription such as side effects or what to do in the event of overdosage or skipped medication, is contained in additional information sheets. However, the patient upon receiving the prescription medication almost always tears open the bag and throws away the additional information. The additional information is rarely read by the patient.

Figure 5:
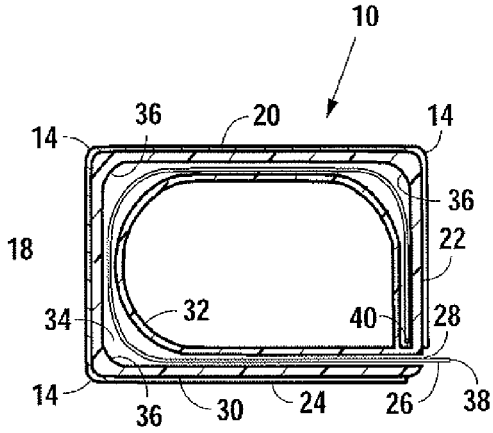
FIG. 5 is a cross-sectional view of FIG. 2 along section lines 5-5.

The present invention shows a pharmacy bottle 10 that has a slot 28 in which an ancillary information sheet 26 can be inserted. The pharmacy bottle 10 has an external wall 30 spaced apart from and internal wall 32 (see FIG. 5). The slot 28 connects to the space 34 formed between the external wall 30 and internal wall 32. By having rounded internal corners 36, an ancillary information sheet 26 can be inserted through slot 28 and wrapped around the internal wall 32 in a manner as shown in FIG. 5. By proper planning on the size of the ancillary information sheet 26, a tab 38 will remain visible by extending beyond the slot 28. The tab 38 may contain the patient's name or the type of medication thereon. The ancillary information sheet 26 wraps around between the external wall 30 and the internal wall 32 until it reaches a terminating wall 40 (see FIG. 5).

A typical ancillary information sheet 26 is shown in FIG. 15. The patient's name and the drug being prescribed may be on opposite sides of the tab 38. The ancillary information sheet 26 as shown in FIG. 15 is folded along the center line. The ancillary information sheet 26 will give considerable additional information about the prescription medication than is physically possible to put on the label 24. Thereafter, if the patient wants to read further information about the medication, the patient can do so, including such things as side effects, drug interactions, precautions or other drug related information.

To hold the ancillary information sheet 26 in place, side tabs 42 are provided on either side thereof (see FIG. 15). The side tabs 42 will deform when inserted through slot 28, but thereafter resist the removal of the ancillary information sheet 26. With a slight tug, the patient can overcome the resistance of the side tabs 42 and remove the ancillary information sheet 26 from the slot 28.

The internal wall 32, in combination with the safety cap 12 and a bottom for the pharmacy bottle 10, forms a totally enclosed container for the prescription medication. No access is provided to the inside of the totally enclosed container except by removing the safety cap 12. There is no connection between the space 34 formed between the external wall 30 and the internal wall 32 and the inside of the pharmacy bottle 10. This lack of connection prevents contamination of the prescription medication.

Figure 1A:
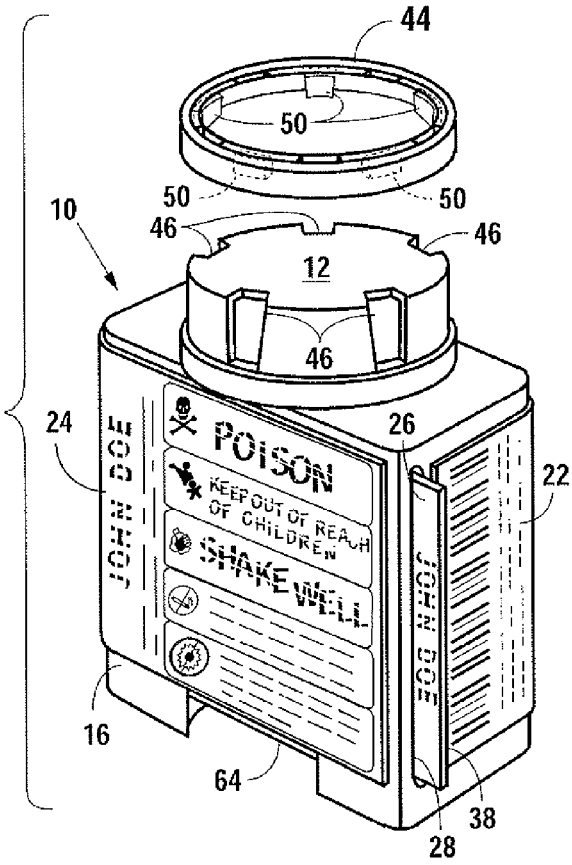
FIG. 1A is a perspective view of a pharmacy bottle for prescription medication.
Figure 1B:
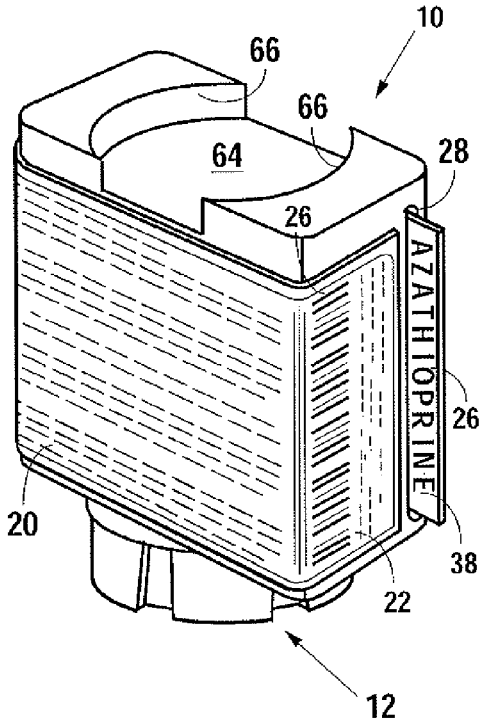
FIG. 1B is another perspective view of the pharmacy bottle for prescription medication as shown in FIG. 1A.
Figure 2:
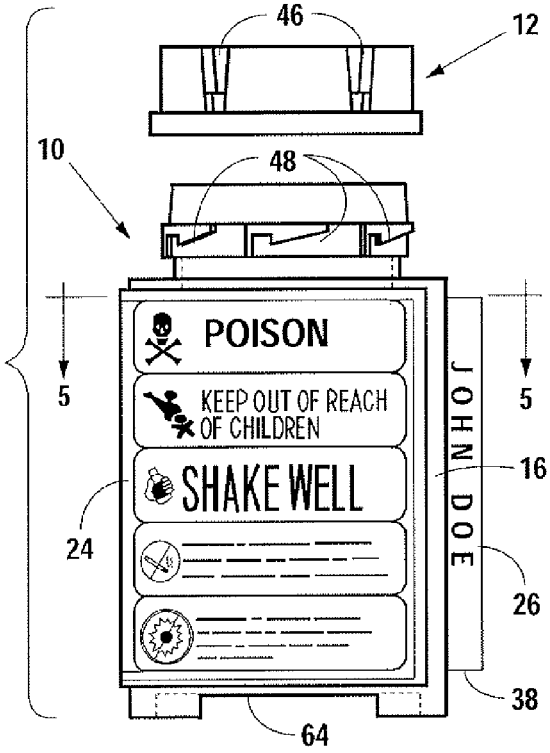
FIG. 2 is a front view of the pharmacy bottle shown in FIGS. 1A and 1B with the cap exploded therefrom.
Figure 4:
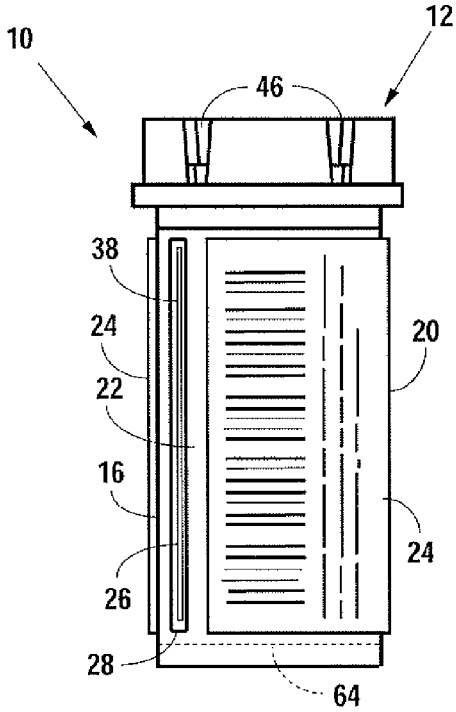
FIG. 4 is a side view of the pharmacy bottle shown in FIGS. 1A and 1B.

In FIG. 1A, a colored ring 44 is shown exploded above the safety cap 12. The safety cap 12 has indentions 46 formed therein. The indentions 46 form internal tabs (not shown) that connect with locking lugs 48 as shown in FIG. 2. Extending inward and down from the colored ring 44 are internal ring tabs 50. The internal ring tabs 50 fit into the indentations 46 in the safety cap 12. By use of the internal ring tabs 50 inserted into the indentations 46, the colored ring 44 can be secured on the safety cap 12.

Figure 1C:
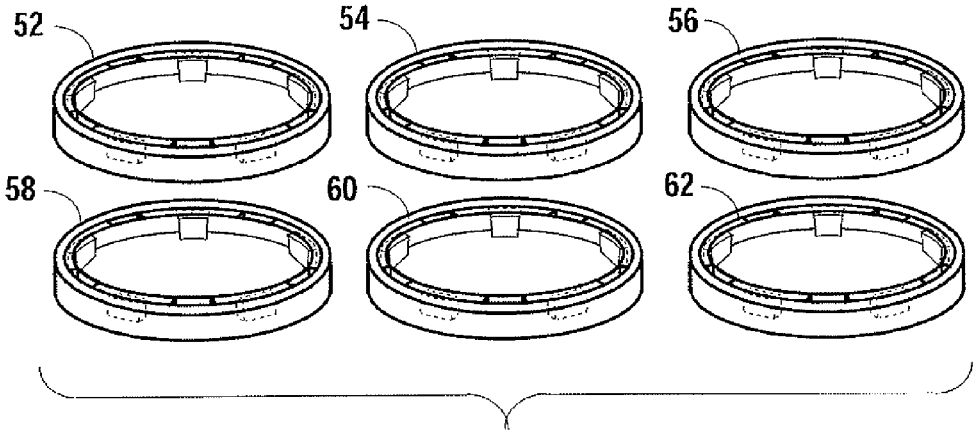
FIG. 1C is a perspective view of different colored rings that can be attached to the bottle cap as shown in FIGS. 1A and 1B.
Figure 3:
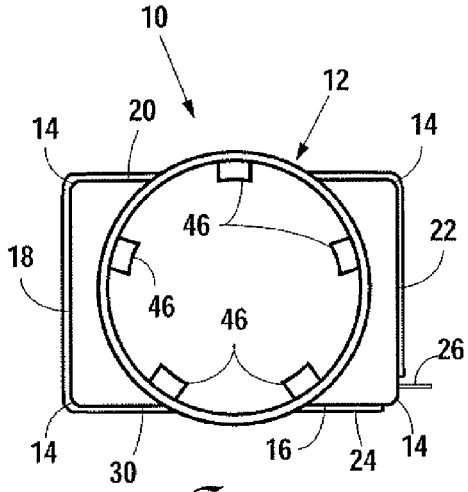
FIG. 3 is a top view of the pharmacy bottle shown in FIGS. 1A and 1B.

By having a selection of colored rings such as (a) white colored ring 52, (b) black colored ring 54, (c) red colored ring 56, (d) green colored ring 58, (e) blue colored ring 60 or (f) brown colored ring 62 as shown in FIG. 1C, the patient can select whatever color the patient so desires to provide reminders to the patient. For example, if there is more than one person in the household, a different colored ring 44 can be used to indicate the particular patient's medication. If a visual reminder is desired to provide the patient information as to which time of day a particular medication should be taken, for example black colored ring 54 could indicate the medication is taken in the evening and white colored ring 52 could indicate the medication is taken in the morning.

Even a combination of colored rings can be used. For example, the outermost colored ring can indicate the particular patient and the innermost colored ring could indicate the time of day the medication should be taken.

To add to the convenience of the pharmacy bottle 10 and to make it more user friendly in the medicine cabinet, a circular indentation 64 is provided in the bottom thereof. The circular indentation 64 has arcing walls 66 on either side thereof. The circular indentation 64 and the arcing wall 66 are just enough so that the safety cap 12 with any colored rings 44 thereon will fit inside of the circular indentation 64. This allows similar shaped pharmacy bottles to be stacked inside of a medicine cabinet where the patient resides.

Figure 6A:
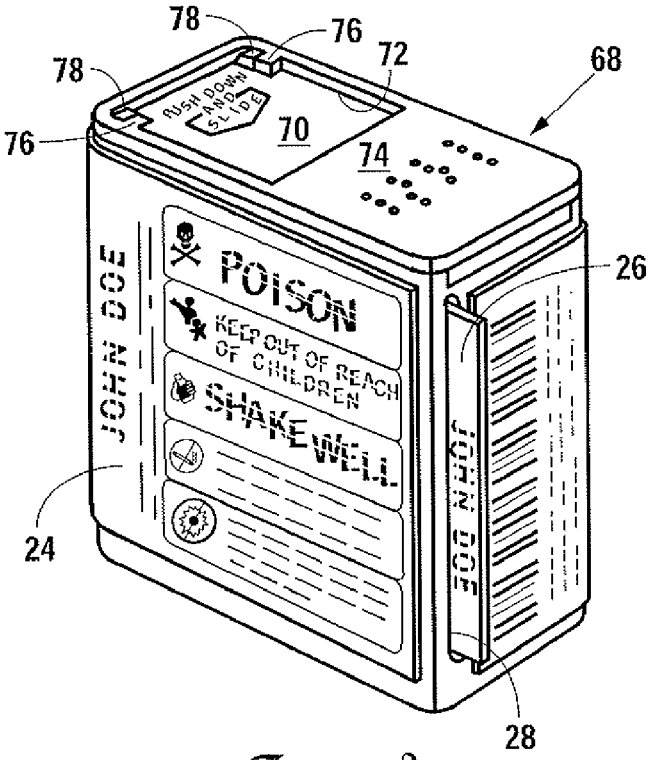
FIGS. 6A and 6B are a pharmacy bottle for prescription medication dispensed in pill form with a slideable top opening.
Figure 6B:
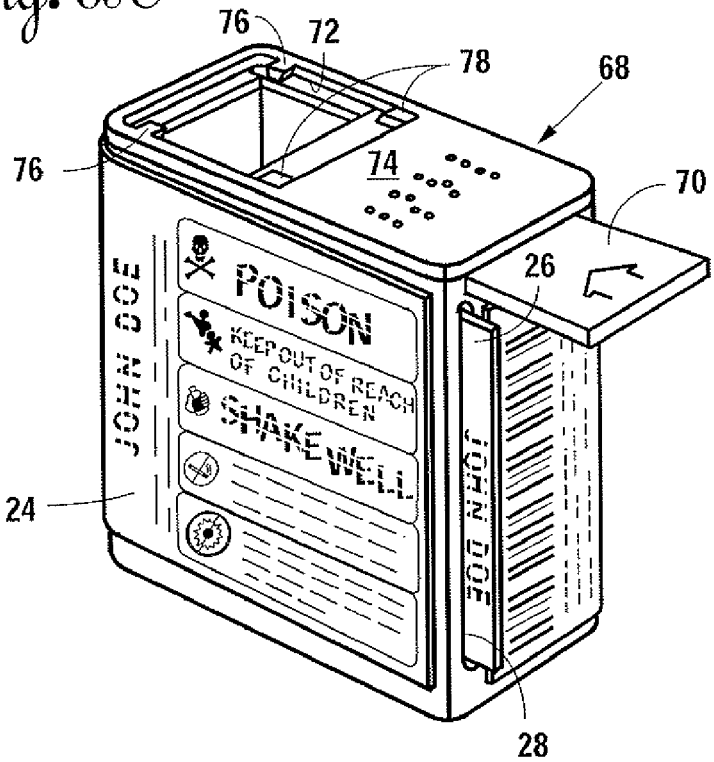

Referring now to FIGS. 6A and 6B in combination, a pharmacy container 68 is shown for solid medication such as pills. The pharmacy container 68 has a label 24 adhered thereto similar to the label 24 described in conjunction with FIGS. 1A and 1B. Also, the pharmacy container 68 has an ancillary information sheet 26 again, similar to the ancillary information sheet 26 described in conjunction with FIGS. 1A and 1B. An ancillary information sheet 26 is shown in FIG. 15 and a typical label 24 is shown is FIG. 14.

The pharmacy container 68 does not have the traditional screw on cap, but instead has a slideable lid 70 to close opening 72 in top 74. Opening 72 has tabs 76 on either side thereof. The tab 76 abuts raised portions 78 on either side of sliding slideable lid 70 to keep the opening 72 closed when medication is not being retrieved from pharmacy container 68. FIG. 6A illustrates the slideable lid 70 in the closed position. FIG. 6B illustrates the slideable lid 70 in the opened position. The pharmacy container 68 as shown in FIGS. 6A and 6B is stackable within the pharmacy cabinet. Also, the pharmacy container 68 has the maximum space available for the label 24 to convey the most information to the patient. Also, ancillary information sheet 26 is inserted through slot 28 into a space similar to space 34 as described in conjunction with FIGS. 1A, 1B, 2, 3, 4 and 5.

Figure 7:
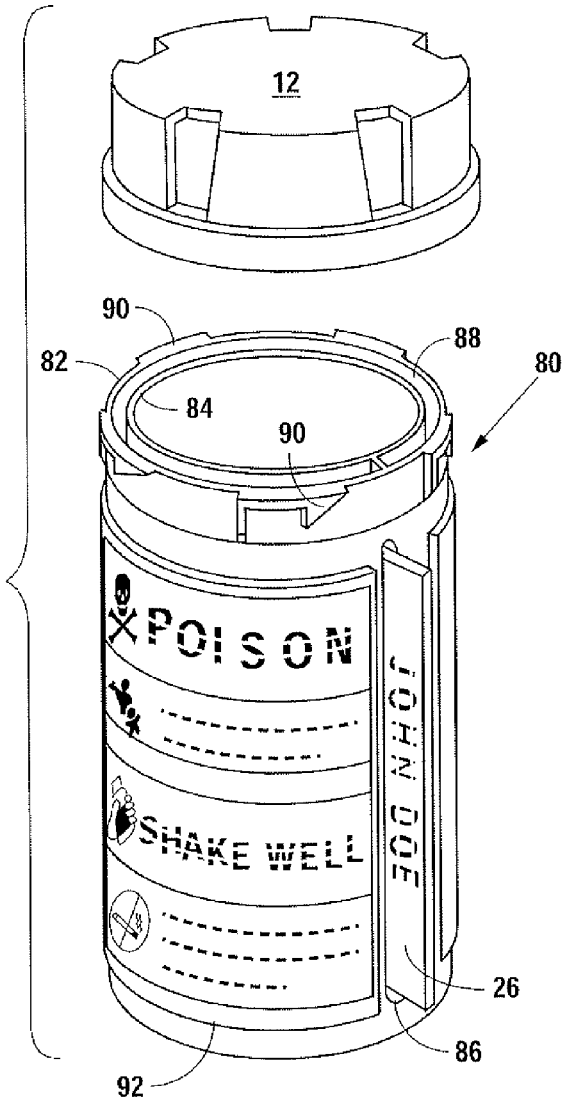
FIG. 7 is a perspective view of a circular pharmacy bottle for prescription medication with the bottle cap exploded therefrom.
Figure 8:
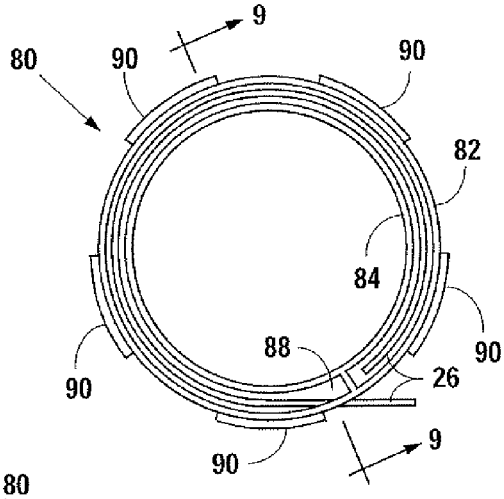
FIG. 8 is a top view of the pharmacy bottle shown in FIG. 7.
Figure 9:
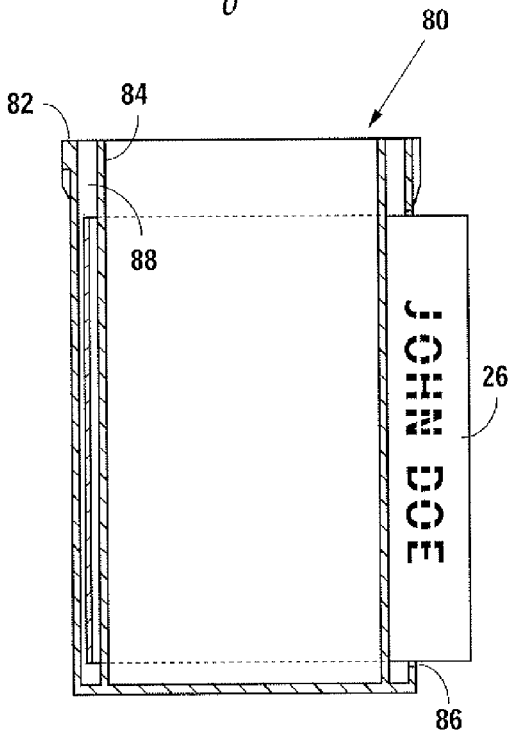
FIG. 9 is a cross-sectional view of FIG. 8 taken along section lines 9-9.
Figure 11:
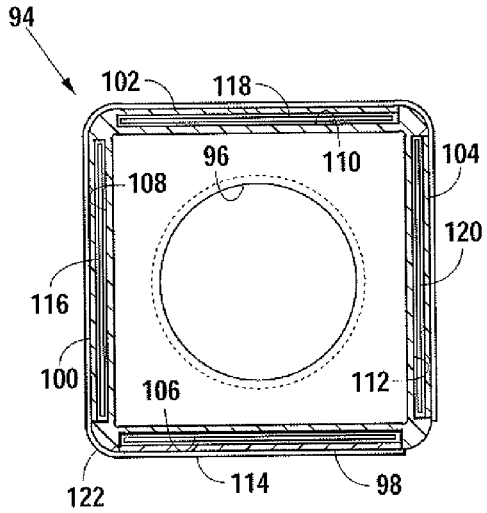
FIG. 11 is a cross sectional view of FIG. 10 taken along section line 11-11.
Figure 12:
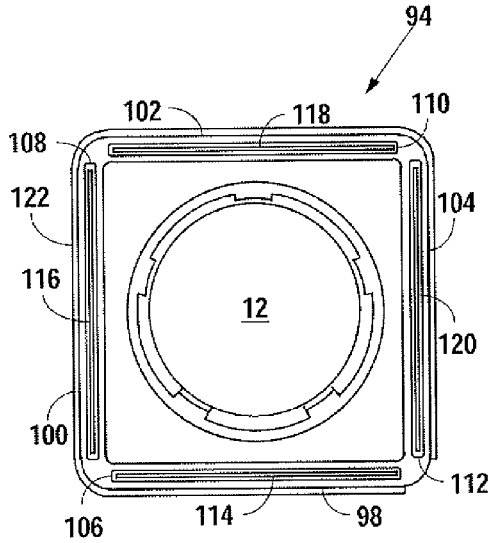
FIG. 12 is a top view of the pharmacy bottle shown in FIG. 10.
Figure 10:
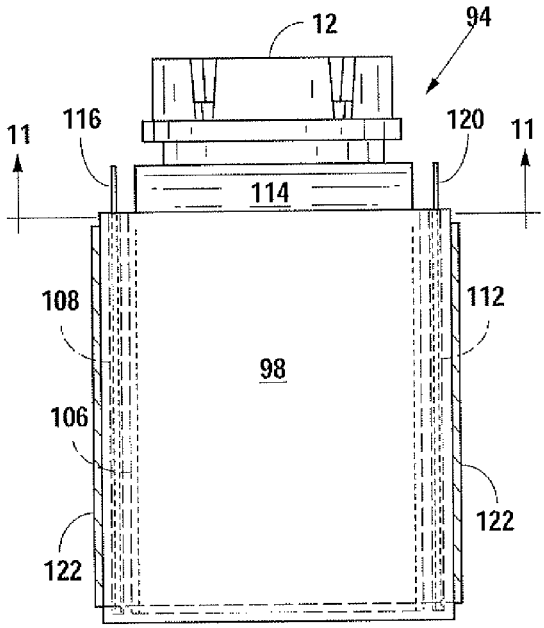
FIG. 10 is a front view of a rectangular pharmacy bottle for prescription medication.
Figure 13:
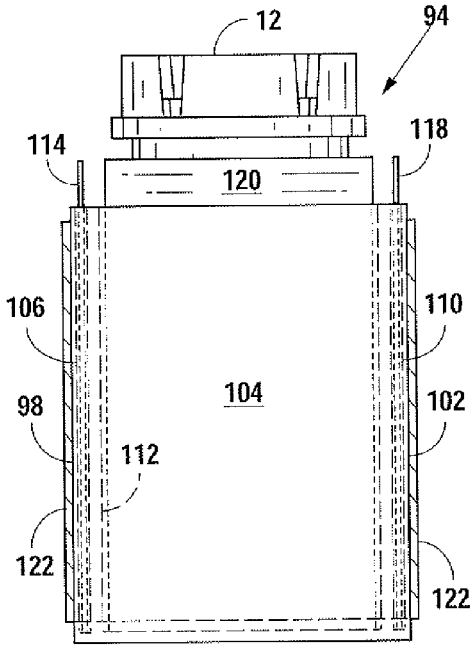
FIG. 13 is a side view of the pharmacy bottle shown in FIG. 10.

Referring now to FIGS. 7, 8, and 9 in combination, another alternative design is shown for a pharmacy bottle 80. The pharmacy bottle 80 has a safety cap 12, the same as illustrated in FIG. 1A. The pharmacy bottle 80 which is of a cylindrical shape, has an external cylinder 82 and internal cylinder 84. The external cylinder 82 is approximately the same size and shape as a thirty dram prescription container with a Friendly & Safe cap as manufactured by Berry Plastics Corporation. However, the external cylinder 82 has a slot 86 therein through which an ancillary information sheet 26 can be inserted. The ancillary information sheet 26 is similar to the ancillary information sheet shown in FIG. 15.

While the ancillary information sheet 26 will have further information about the prescription medication, the ancillary information sheet 26 may have other information as well. For example, coupons or discounts for related medication could be included to increase sales of the pharmacy. Other marketing information could be included to increase sales of other products, related or unrelated.

The internal cylinder 84 is of a smaller diameter then external cylinder 82 and may have a diameter similar to the diameter of a twenty dram prescription medication bottle as manufactured by Berry Plastics Corporation, except there are no locking tabs at the top thereof. The internal cylinder 84 inside of external cylinder 82 defines a cylindrical space 88 therebetween. Therefore, when the ancillary information sheet 26 is inserted through slot 86, it is directed by the internal cylinder 84 into the cylindrical space 88 and wraps therearound as can be seen in the top view of FIG. 8 and the cross-sectional view of FIG. 9. The external cylinder 82 will have locking tabs 90 thereon for engaging the safety cap 12 in the same manner as described in connection with FIG. 2. The label 92 that is applied to the pharmacy bottle 80 would contain the traditional information thereon as is normally contained on labels adhered to thirty dram bottles.

Referring to FIGS. 10, 11, 12, and 13 in combination, a square pharmacy container 94 is illustrated. The square pharmacy container 94 may have the traditional safety cap 12 attached to top thereof to close the top opening 96. The side walls of the square pharmacy container 94 consists of a front wall 98, left side wall 100, back wall 102 and right side wall 104. The walls 98, 100, 102 and 104 are thicker than most pharmacy containers so that slots 106, 108, 110 and 112 are formed in each of the walls 98, 100, 102 and 104, respectively. While the depth of the slots 106, 108, 110, and 112 can be any depth, the most desirable depth would be slightly short of the height of the square pharmacy bottle 94 so that the slots 106, 108, 110, or 112 does not extend through the bottom thereof. Into each of these slots 106, 108, 110, and 112, can be inserted ancillary information sheets 114, 116, 118 and 120, respectively. The ancillary information sheets 114, 116, 118 and 120 can put additional drug information thereon and be inserted into the respective slots 106, 108, 110, and 112. If the pharmacy wants to convey additional information (such as sales or coupons) to the patient, it can also be inserted in one of the slots 106, 108, 110 or 112.

The traditional information for most drugs will be contained on the stick on label 122 that wraps around the square pharmacy container 94. An example of the traditional information, but arranged in a different format, is shown in the label 24 in FIG. 14.

In the present invention, the objective is to convey as much information to the patient as possible either in the stick on label or in ancillary information sheets that remain with the pharmacy bottle. To keep the ancillary information sheets with the pharmacy bottle, a slot is provided in the pharmacy bottle in which the ancillary information sheet may be inserted. Colored rings may be attached to the bottle to provide further quick visual reminders to the patient when taking the medication.

I claim:

1. A pharmacy bottle for dispensing prescription medication to a patient in a manner to convey information in a clear understandable manner, said pharmacy bottle comprising:

a container having a top, bottom and substantially vertical side walls;

an opening formed in said top;

a cap for removably closing said opening through which said prescription medication is dispensed, said cap having indentations in an outer surface thereof;

a label having information about said prescription medication printed thereon, said label being adhered to said substantially vertical side walls;

a slot in said substantially vertical side walls connecting to space within said substantially vertical side walls;

ancillary information sheet having more information thereon about said prescription medication inserted through said slot into said space within said substantially vertical side walls said ancillary information sheet having a tab extending from said slot so that upon pulling said tab said ancillary information sheet can be removed and reviewed;

said substantially vertical sidewalls having an inner wall and an outer wall, said slot being through said outer wall to said space therebetween;

said inner wall being formed by an inner bottle and said external wall being formed by an external bottle, said inner bottle and said external bottle being connected together on at least one end thereof, said cap removably connecting to said external bottle; and colored rings to convey information to said patient, said colored rings having internal ring tabs removably inserted into said indentations in said cap.

2. The pharmacy bottle for dispensing said prescription medication to said patient in a manner to convey said information in a clear understandable manner as recited in claim 1 having a circular indention in a bottom thereof, said circular indention being slightly larger than said cap to allow stacking of said pharmacy bottle with another pharmacy bottle of similar shape.

3. The pharmacy bottle for dispensing said prescription medication to said patient in a manner to convey said information in a clear understandable manner as recited in claim 1 wherein said container is rectangular with rounded corners, said slot for said ancillary information sheet being substantially vertical and near a corner of said outer wall, said tab of said ancillary information sheet extending outside said slot.

4. The pharmacy bottle for dispensing said prescription medication to said patient in a manner to convey said information in a clear understandable manner as recited in claim 1 wherein said container is rectangular, said slot for said ancillary information sheets being vertical and near a top corner of said outer wall.

5. The pharmacy bottle for dispensing said prescription medication to said patient in a manner to convey said information in a clear understandable manner as recited in claim 4 wherein there is a plurality of said slots for receiving a plurality of said ancillary information sheets.

6. The pharmacy bottle for dispensing said prescription medication to said patient in a manner to convey said information in a clear understandable manner as recited in claim 1 wherein said pharmacy bottle is circular.

* * * * *